US005903288A

United States Patent [19]

Yamaguchi

[11] Patent Number: 5,903,288

[45] Date of Patent: May 11, 1999

[54] APPARATUS AND METHOD FOR FLUSHING INK-JET RECORDING HEADS WITHOUT SUSPENSION OF PRINTING

[75] Inventor: Shuichi Yamaguchi, Nagano, Japan

[73] Assignee: Seiko Epson Corporation, Tokyo, Japan

[21] Appl. No.: 08/799,927

[22] Filed: Feb. 13, 1997

[30] Foreign Application Priority Data

Feb. 14, 1996 [JP] Japan ..... 8-052407
Mar. 25, 1996 [JP] Japan ..... 8-094867

[51] Int. Cl.[6] ..... B41J 2/165

[52] U.S. Cl. ..... 347/24; 347/23; 347/35

[58] Field of Search ..... 347/24, 23, 35

[56] References Cited

U.S. PATENT DOCUMENTS 4,785,750 11/1988 Best ..... 112/262.1
5,177,505 1/1993 Sugiura et al. .

FOREIGN PATENT DOCUMENTS 0500281 2/1992 European Pat. Off. .
0704307 4/1996 European Pat. Off. .

*Primary Examiner*—N. Le
*Assistant Examiner*—Thien Tran
*Attorney, Agent, or Firm*—Sughrue, Mion, Zinn Macpeak & Seas, PLLC

[57] ABSTRACT

An ink-jet recording device which carries out flushing of the nozzle holes of color-ink recording heads without suspending the printing operation. When flushing of the color-ink nozzle holes is required, the device determines, using bit-map data, whether or not black ink dots are to be printed in nearby locations that correspond to the nozzle holes requiring flushing. If so, flushing is effected by discharging color-ink drops in the locations where black-ink dots are to be formed. Subsequently, the black-ink dots that are larger than the color-ink dots are superposed over the color-ink dots, thereby concealing the color-ink dots. Alternatively, flushing of the nozzle holes of the color-ink recording heads is effected by discharging each of three colors at a location where a black-ink dot is to be formed, thereby forming a composite black dot and obviating the necessity to superpose a black-ink dot.

18 Claims, 9 Drawing Sheets

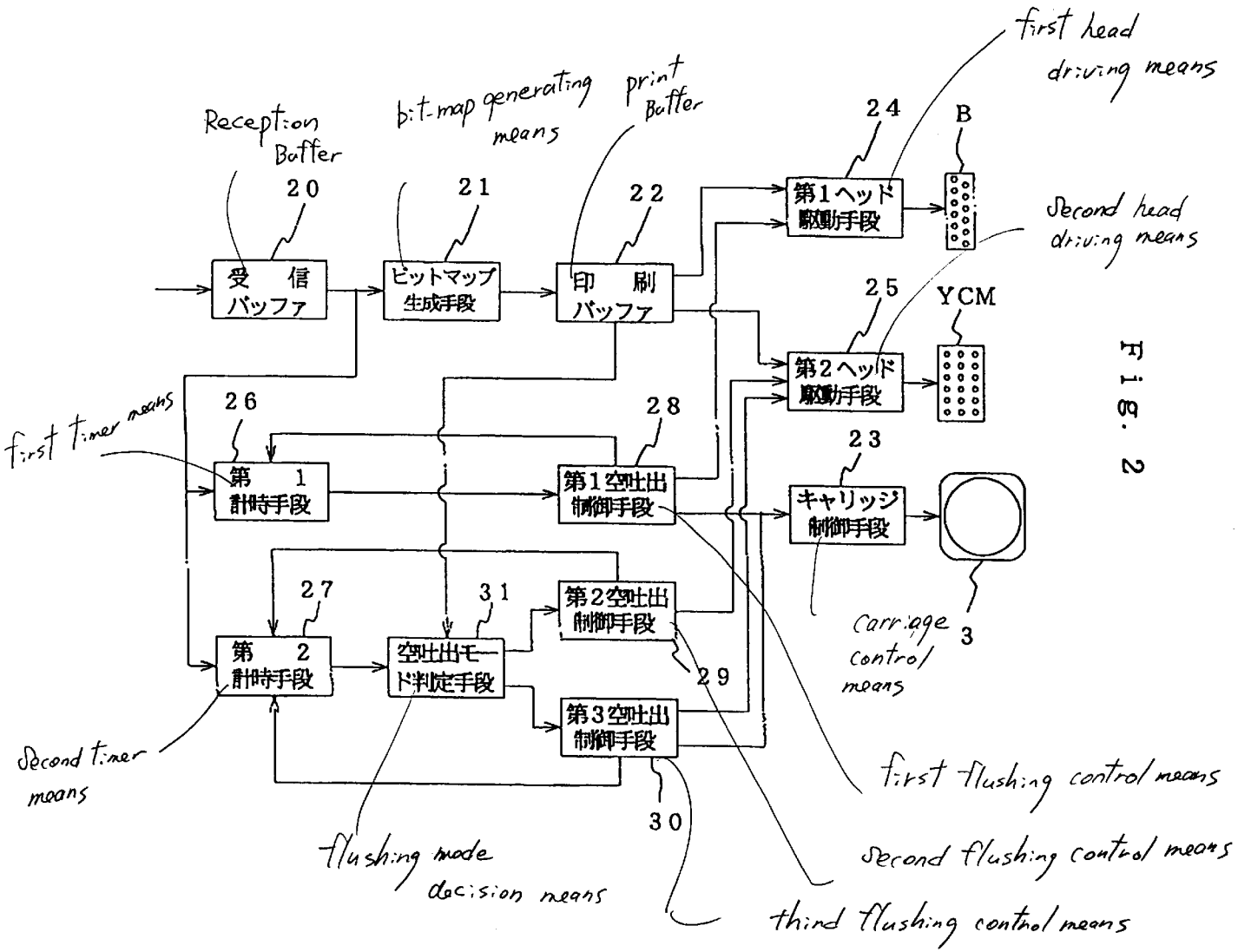
Fig. 2
First head driving means
Second head driving means
B
YCM
24
25
23
3
第1ヘッド駆動手段
第2ヘッド駆動手段
キャリッジ制御手段
Carriage control means
First flushing control means
Second flushing control means
third flushing control means
22
28
29
30
印刷バッファ
第1空吐出制御手段
第2空吐出制御手段
第3空吐出制御手段
print Buffer
bit-map generating means
21
31
ビットマップ生成手段
空吐出モード判定手段
Flushing mode decision means
Reception Buffer
20
27
受信バッファ
第2計時手段
26
第1計時手段
First timer means
Second timer means

APPARATUS AND METHOD FOR FLUSHING INK-JET RECORDING HEADS WITHOUT SUSPENSION OF PRINTING

BACKGROUND OF THE INVENTION

1. Field of the Invention

The present invention relates to an ink-jet recording apparatus for printing patterns on a recording medium by discharging ink drops from nozzle holes.

2. Description of the Related Art

A typical ink-jet recording apparatus employs a recording head adapted for use in discharging ink drops from nozzle holes after pressurizing ink in pressure generating chambers by means of piezoelectric vibrators and heating elements. It is desirable in such an ink-jet recording apparatus to take measures to prevent print quality deterioration resulting from the presence of dried ink near nozzle holes and dust sticking to the nozzle holes.

One of the measures that has been taken is a so-called flushing operation in which ink drops are flushed out of the nozzle holes, irrespective of print data, by moving the recording head to a capping unit on standby in a non-print area each time the printing operation continues for a predetermined period, for example, 20 seconds.

Viscous ink sticking to a nozzle hole that has not discharged any ink drops or that has discharged only a few ink drops during the printing operation is thus made removable by discharging ink drops every predetermined period, irrespective of the printing operation. Consequently, the period of time before the nozzle hole becomes clogged with ink can be prolonged.

The ink-jet recording apparatus is loaded with two kinds of recording heads; namely, a black-ink recording head for discharging black ink and a color-ink recording head for discharging yellow, cyan and magenta ink, so that black ink and color ink are supplied to the respective recording heads.

Since solvents for use in black ink and color ink are different, as are their drying speeds, the flushing periods of the two kinds of recording heads are different. Particularly when quick-drying ink is used during color printing, one problem is that the printing speed decreases because the flushing operation is more frequently needed.

Consideration has been given to the use of an ink-jet recording head having high color printing performance for printing color label patterns. In this application, the paper feed function of a recording apparatus and the movement of its carriage are used for a so-called label issuing apparatus for cutting out the color label patterns with a cutting tool. However, the carriage movement path becomes longer because label paper wider than ordinary office recording media is used for labels. Consequently, it takes a considerable amount of time to move the recording head to a capping unit for flushing purposes. In other words, the use of conventional capping means as an ink receiver, such as the capping means used in an ordinary office recording apparatus, incurs a reduction in printing speed, thereby creating an obstacle to the commercial utilization of such a label issuing apparatus.

SUMMARY OF THE INVENTION

The present invention has been made in view of the aforementioned problems. One object of the present invention is to provide an ink-jet recording apparatus capable of improving printing speed by reducing the amount of time printing is suspended to perform a flushing operation.

Another object of the present invention is to provide an ink-jet recording apparatus capable of improving the speed of printing on a large-sized recording medium without any suspension of printing for performing a flushing operation.

To overcome the aforementioned problems, an ink-jet recording apparatus according a preferred embodiment of the present invention comprises a carriage which reciprocates in the width direction of a recording medium and which is loaded with a black-ink recording head for discharging black ink drops and color-ink recording heads for discharging color ink drops. The recording heads are periodically subjected to flushing during the printing operation in order to maintain the ink-drop discharge performance of the recording heads. The ink-jet recording apparatus is provided with flushing mode decision means for determining the presence or absence of an area on which dots with black ink are to be formed, which area corresponds to at least flush-requiring nozzle holes among the nozzle holes of the color-ink recording heads according to bit-map data in the black-ink recording head. The apparatus further includes flushing control means for causing, without suspension of the printing operation, one-color ink drops to be discharged to one place from the flush-requiring nozzle holes of the color-ink recording heads when the flush-requiring nozzle holes face a position where black ink dots other than dots corresponding to print data are to be formed. When flushing of the color-ink recording heads is needed, the flush-requiring nozzle holes of the color-ink recording heads are moved to a position where black ink dots other than dots corresponding to print data are to be formed, and ink drops are discharged from the nozzle holes. Then, black ink dots are superposed by printing on the color dots formed by flushing according to the print data, whereby the color dots formed by flushing can be concealed with the black dots.

According to another preferred embodiment of the present invention, an ink-jet recording apparatus comprises a carriage which reciprocates in the width direction of a recording medium, an ink-jet recording head for discharging ink drops, a cutting mechanism which reciprocates in the width direction of the recording medium and is used for cutting out a predetermined area, and a paper feed mechanism for reciprocating the recording medium in a direction perpendicular to the direction in which the carriage is moved. The apparatus is provided with decision means for determining a flushing area according to cutting pattern data, and for deciding the time of flushing, and control means for subjecting the recording head to flushing while the carriage is moving in the flushing area. Specifically, when flushing of the recording head is needed, flushing is carried out by moving the recording head to a marginal area which is unnecessary for labels and which is to be cut from the label-printing area; thus, it is unnecessary to move the recording head to a more remote capping unit.

DESCRIPTION OF THE PREFERRED EMBODIMENT

Figure 1:
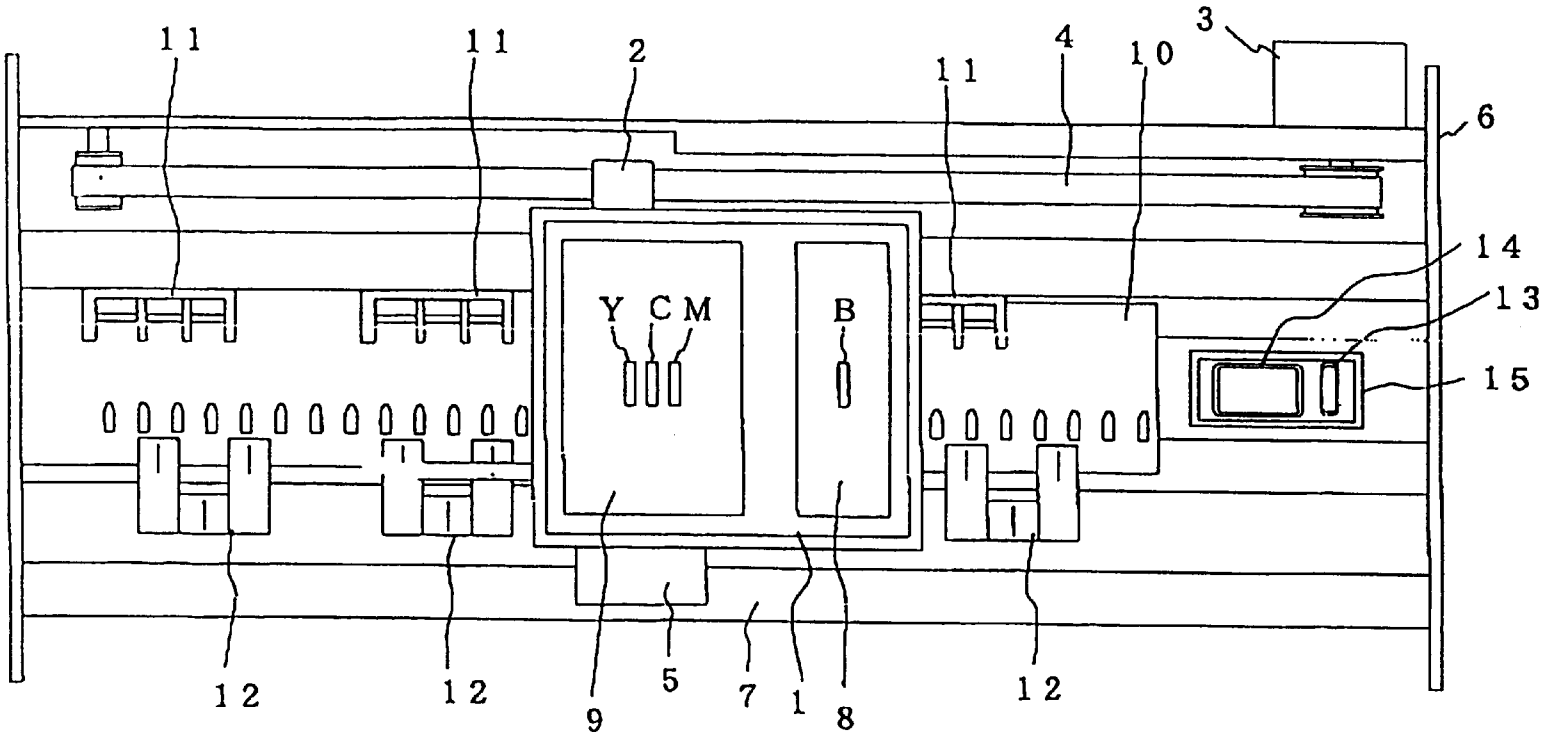
FIG. 1 is a plan view of an ink-jet recording apparatus according to a first embodiment of the present invention.

FIG. 1 is a plan view showing an ink-jet recording apparatus according to a first embodiment of the present invention. In FIG. 1, reference numeral 1 denotes a carriage with one end connected to a timing belt 4 which is driven by a motor 3 via a coupling member 2 and the other end supported with the guide member 7 of a casing 6 by a sliding member 5, so that the carriage 1 is able to reciprocate in the width direction of recording paper.

The following recording heads are provided opposite to recording paper of the carriage 1: a black-ink recording head B provided on a non-print area side and used for printing text; and recording heads Y, C, M provided on a print area side and respectively used for applying yellow, cyan and magenta ink. On the surface of the carriage 1 are a black-ink cartridge 8 and a color-ink cartridge 9 for storing yellow, cyan and magenta ink, these cartridges being detachable.

A platen 10 is large enough to cover the print area. On the surface of the platen 10 are paper feed rollers 11 for conveying recording paper from a paper feed cassette (not shown), and paper discharge rollers 12 for guiding a print-terminating area, the paper feed rollers 11 and the paper discharge rollers 12 being situated on the rear side (upper side in FIG. 1) and on the front side (lower side in FIG. 1), respectively.

Further, a capping unit 15 is provided in the non-print area into which the carriage 1 retracts during the time the print operation is suspended. The capping unit 15 is provided with a cap member 13 for sealing up the black-ink recording head B in the farthest position from the print area and a cap member 14 for sealing up the color-ink recording heads Y, C, M in a position closer to the print area.

Figure 2:
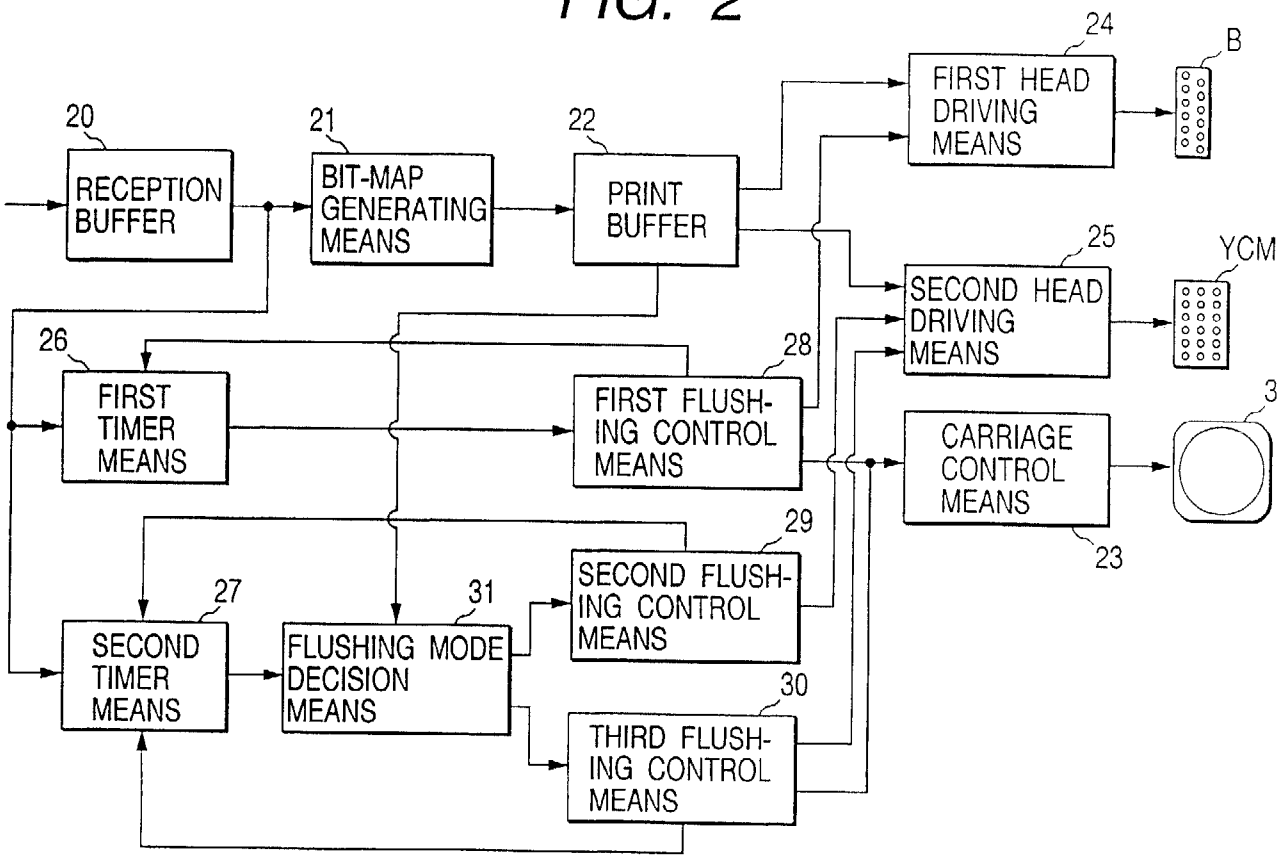
FIG. 2 is a block diagram of control means in the apparatus shown in FIG. 1.
Figure 3:
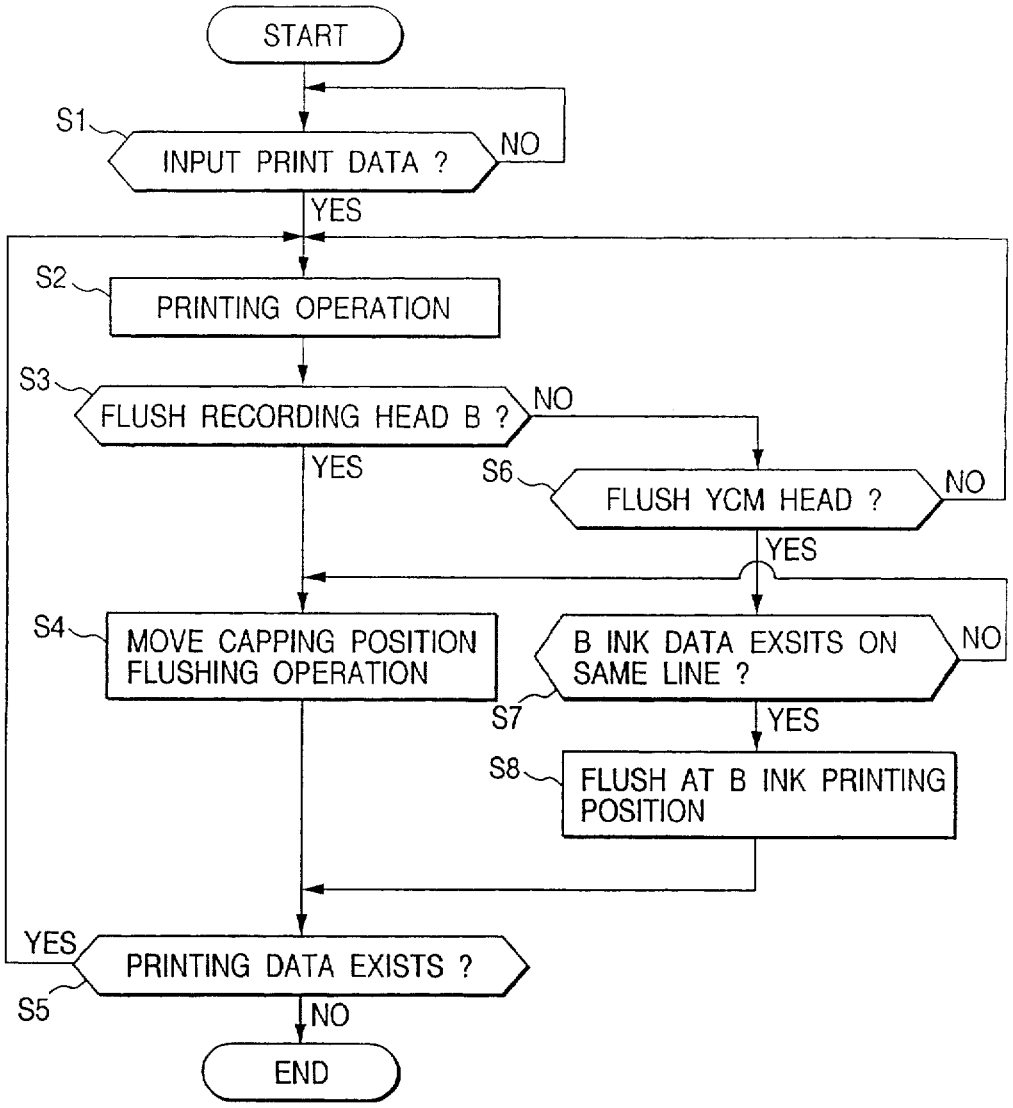
Figure 4A:
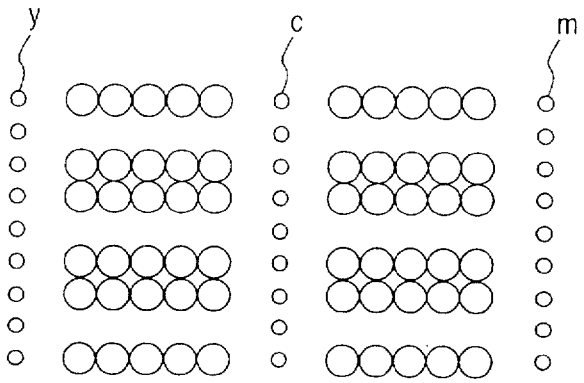
Figure 4B:
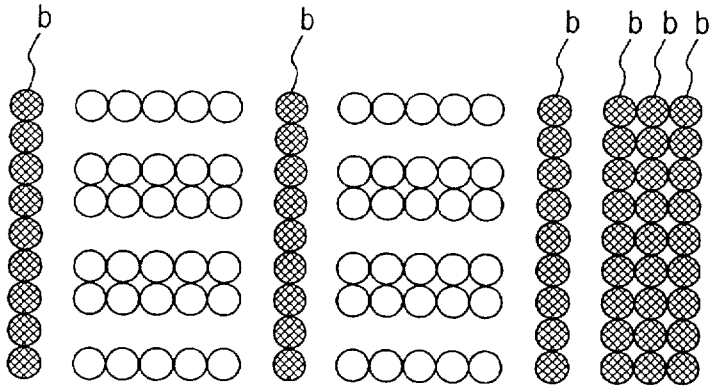
Figure 5:
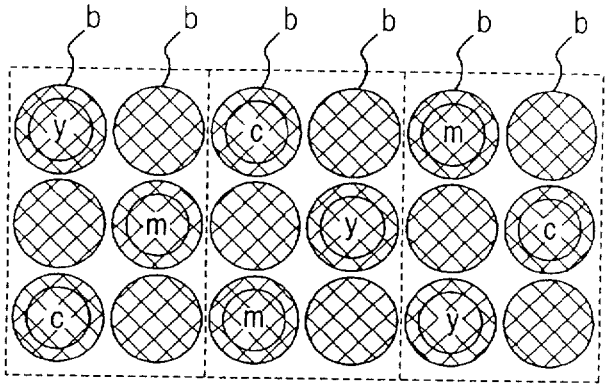
Figure 6:
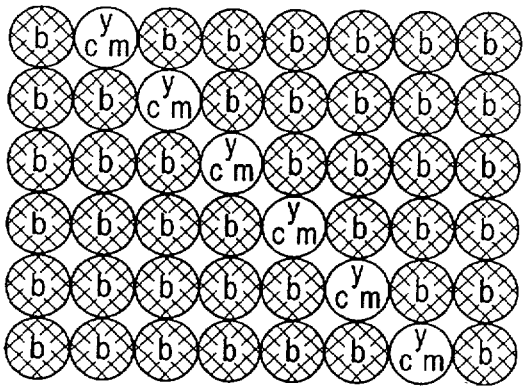
Figure 7:
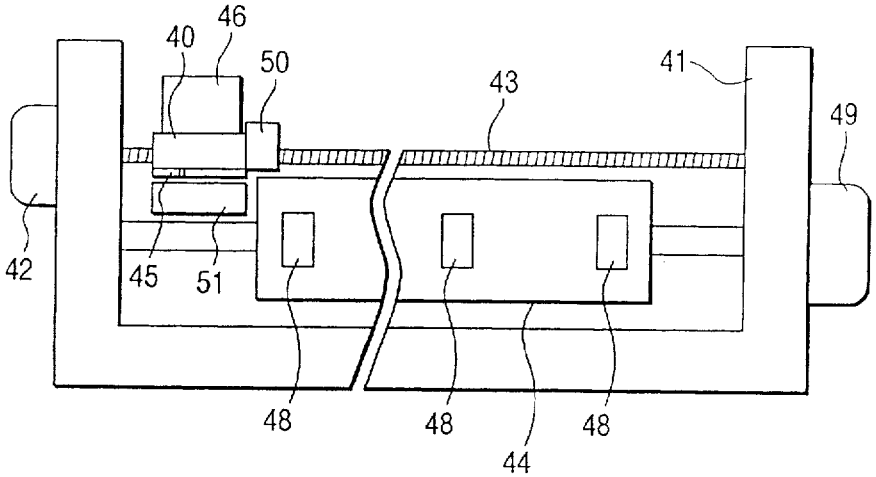
Figure 9:
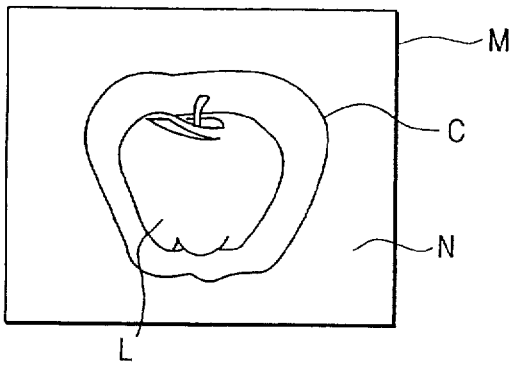
Figure 8:
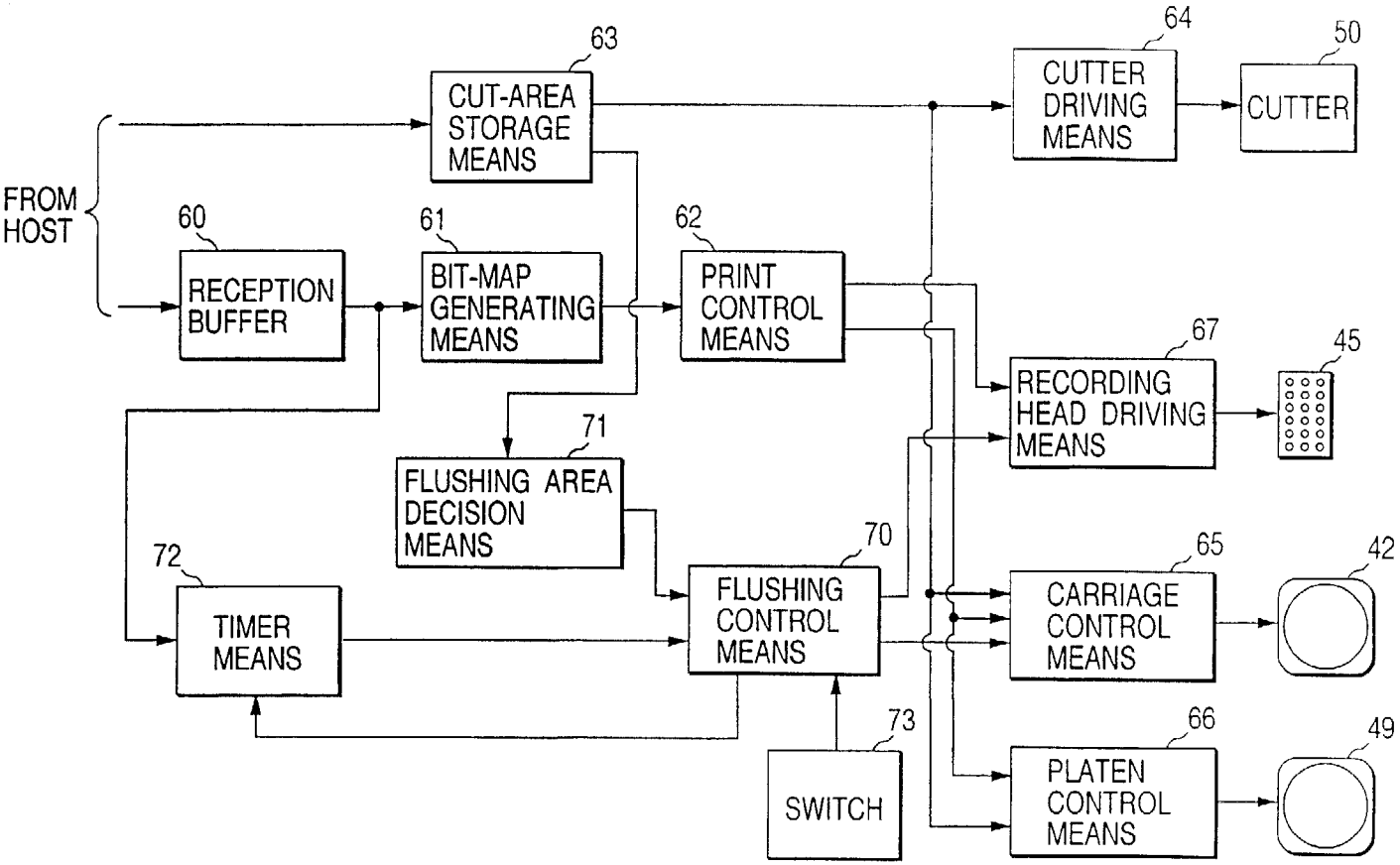
Figure 10:
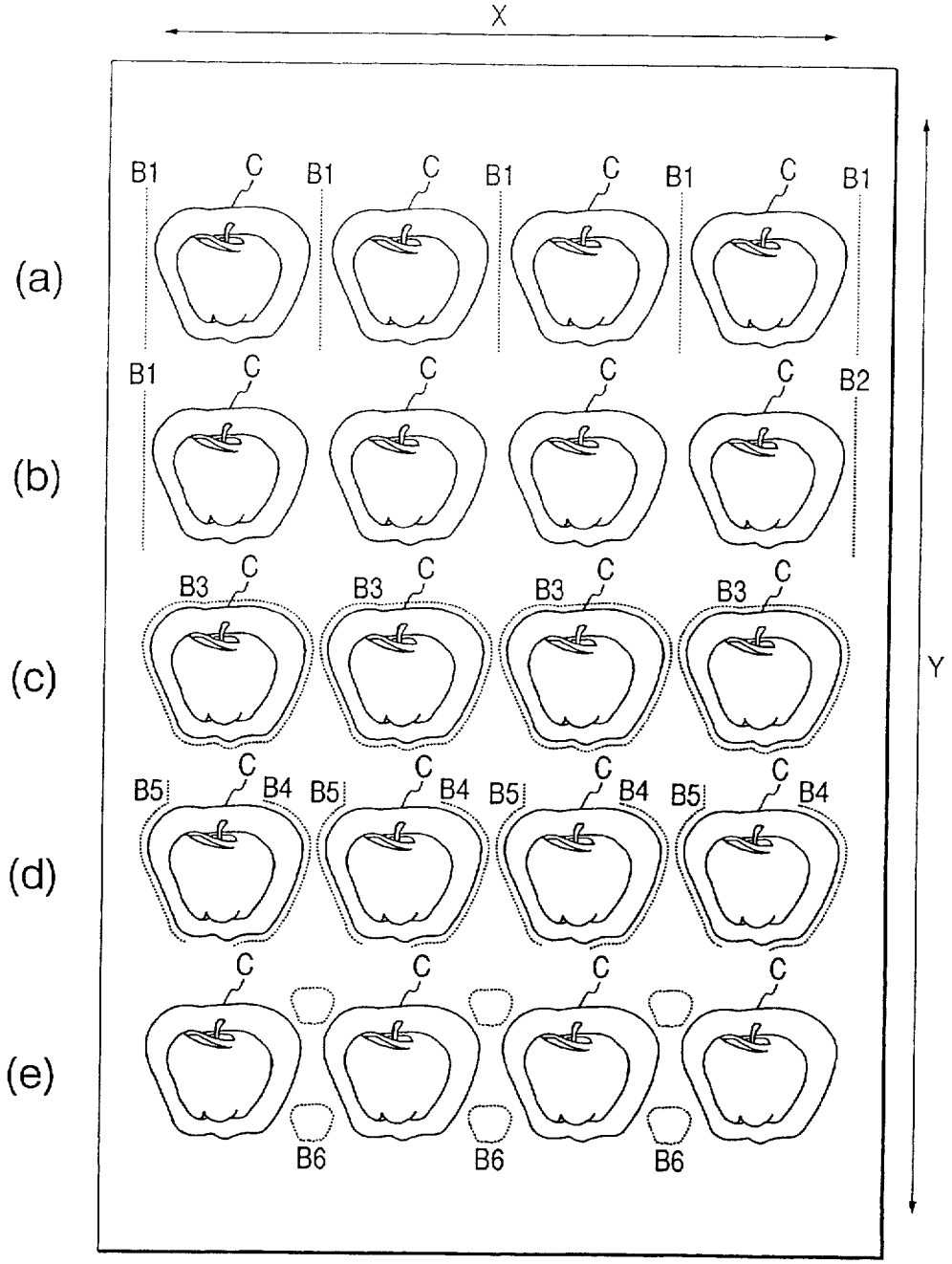
Figure 11:
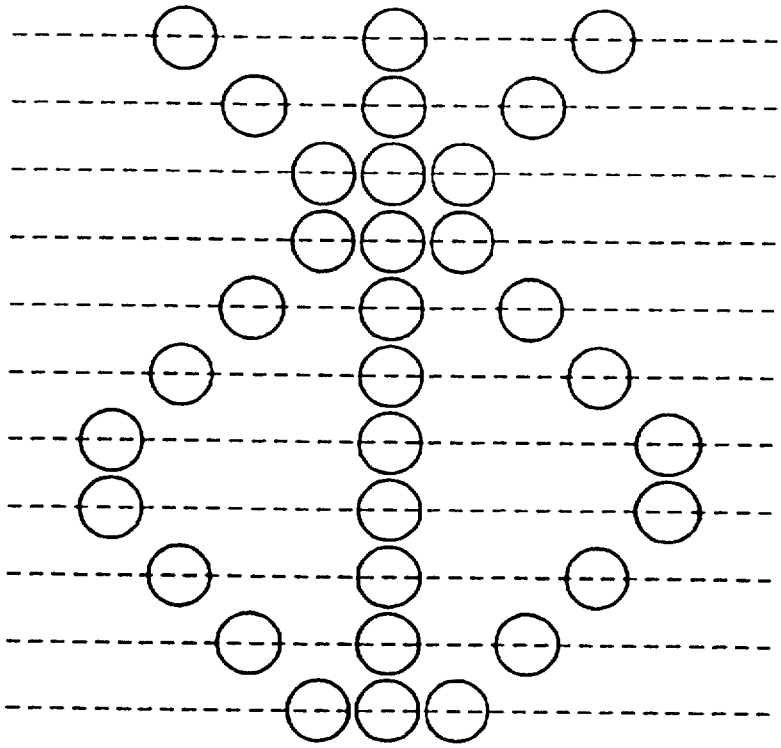

FIG. 2 is a block diagram of a control unit for controlling the aforementioned print mechanism according to the first embodiment of the invention. The control unit comprises a reception buffer 20 for storing print data from a host (not shown); a bit-map generating means 21 for developing image data having a bit map in a print buffer 22 according to the print data stored in the reception buffer 20; a carriage control means 23 for effecting the print operation by reciprocating the carriage 1 and moving the recording heads B, Y, C, M to the capping position for flushing purposes; a first and a second head driving means 24, 25 for outputting drive signals to the black-ink recording head B and the color-ink recording heads Y, C, M according to the bit-map data; a first and a second timer means 26, 27 for measuring print time in the black-ink recording head B and the color-ink recording heads Y, C, M; and a first, a second and a third flushing control means 28, 29, 30, which will be described later, for subjecting the black-ink recording head B and the color-ink recording heads Y, C, M to flushing based on the timing data obtained by the timer means 26, 27.

The first flushing control means 28 subjects the black-ink recording head B to flushing by causing the printing operation to be suspended each time a predetermined period of time passes and by moving the black-ink recording head B to a position where the black-ink recording head B faces the cap member 14 of the color-ink recording heads Y, C, M.

The second flushing control means 29 subjects the color-ink recording heads Y, C, M to flushing by causing a small amount of ink to be jetted through a method of lowering the levels of the drive signals during the ordinary printing operation in a black-ink dot forming area of the print area on the basis of a decision made by a flushing mode decision means 31, which will be described later. The third flushing control means 30 subjects the color-ink recording heads Y, C, M to flushing on the basis of a decision made by the flushing mode decision means 31, by moving the color-ink recording heads Y, C, M to the capping position.

As described above, when the flushing operation is only subjected to the black-ink recording head B, the black-ink recording head B faces the cap member 14 of the color-ink recording heads Y, C, M, because in order to enhance the through put, the flushing operation is subjected on the cap member 14 closer to the printing area. When the flushing operation is subjected to the color-ink recording head Y, C, M, or the color-ink recording head Y, C, M and the black-ink recording head B, the flushing operations thereof are subjected to the cap member 13 of the black-ink recording head B and the cap member 14 of the color-ink recording heads Y, C, M, respectively.

The flushing mode decision means 31 refers to bit map data relating to the black-ink recording head B developed in the print buffer 22 and decides whether an area to be formed with black ink dots exists on a line corresponding to nozzle holes which require at least flushing among the nozzle holes of the color-ink recording heads Y, C, M.

Figure 3:
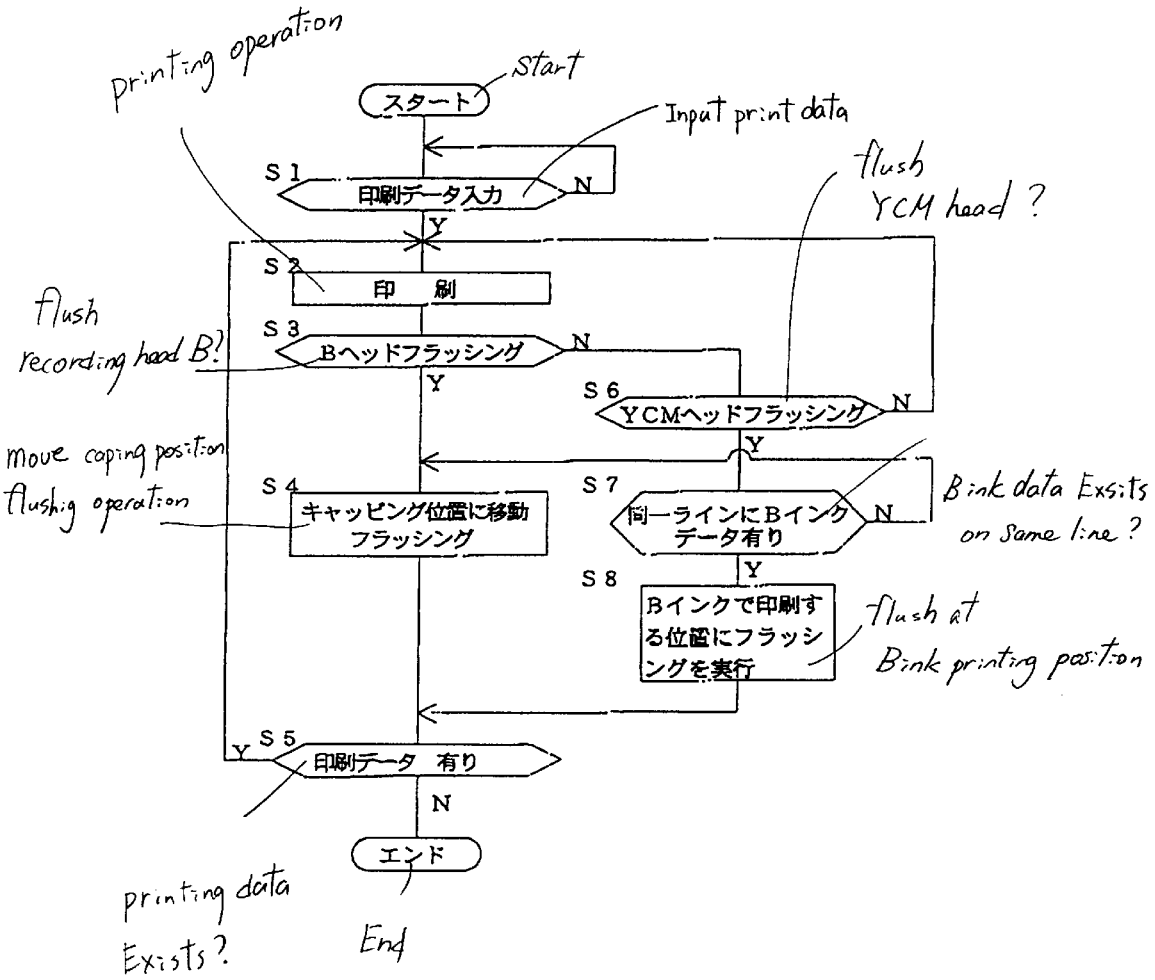
FIG. 3 is a flowchart showing the operation of the apparatus shown in FIG. 1.

The operation of the apparatus thus constructed will subsequently be described by reference to a flowchart of FIG. 3.

When print data is input (S1), the first and second timer means 26, 27 first perform a reset operation and then start a timing operation. When the printing operation is performed after the print data is developed into the bit map data (S2), each of the flushing control means 28, 29, 30 decides the time at which the flushing operation is to be performed by reference to the timing data in the first and second timer means 26, 27.

When the flushing operation is required for the black-ink recording head B (S3) after a predetermined amount of printing is carried out, the first flushing control means 28 suspends the printing operations of the respective recording heads B, Y, C, M and subjects the black-ink recording head B to flushing (S4) by moving the black-ink recording head B up to a position opposite to the cap member 14 for sealing up the color-ink recording heads Y, C, M.

By performing the flushing operation, it is possible to keep print quality constant, since clogging of nozzle holes which were not required to discharge ink during the printing operation or whose discharge amount was extremely small is prevented, and ink-jet performance of these nozzle holes is maintained.

As usual, the flushing operation timing of the color-ink recording head Y, C, M is slower than that of the black-ink recording heads B.

When the flushing operation is needed for the color-ink recording heads Y, C, M this time after the printing operation is thus restarted (S5), a signal is output from the second timer means 27 (S6). The flushing mode decision means 31 refers to the bit-map data about the black-ink recording head B, which bit-map data has been developed in the print buffer 22, and decides whether such an area to be formed with black ink dots exists on a line corresponding to the whole nozzle hole of the flushing-required color-ink recording heads Y, C, M (S7).

When the formation of black-ink dots is expected on a line corresponding to nozzle holes of the color-ink recording heads Y, C, M that have been determined to require flushing (e.g., nozzle holes which are not required to discharge ink at least during the printing operation or whose discharge amount has been extremely small), the second flushing control means 29 causes the flushing-required nozzles to discharge ink drops that are smaller than ink drops normally discharged during the printing operation by lowering the levels of the drive signals, for example, at a point in time when the flushing-required nozzle holes of the color-ink recording heads Y, C, M are moved to a position wherein the formation of black-ink dots other than dots corresponding to the print data is expected, without the suspension of the printing operation (S8).

Figure 4A:
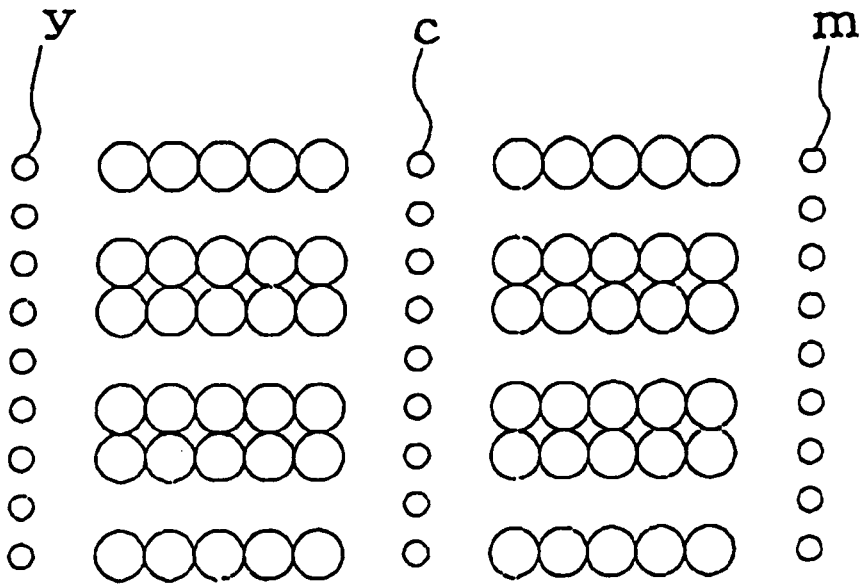
FIGS. 4*a* and 4*b* are diagrams illustrating flushing modes of color-ink recording heads in the apparatus shown in FIG. 1.
Figure 4B:
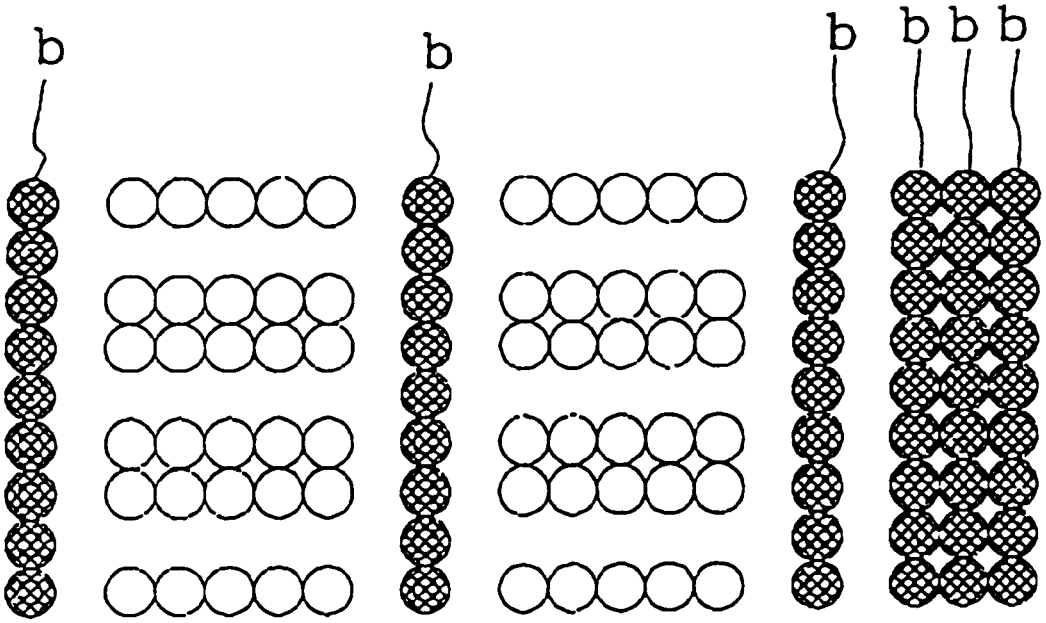

Consequently, as shown in FIG. 4*a*, there are formed small color-ink dots y, c, m due to flushing in addition to color-ink dots corresponding to the print data. Subsequently, as shown in FIG. 4*b*, black dots b, b, b . . . , in agreement with data to be printed with black ink, are formed by the black-ink recording head B in such a manner as to follow an area where print data is printed by the color-ink recording heads Y, C, M (FIG. 4*b*), whereby the small color-ink dots y, c, m formed by the flushing of the color-ink recording heads Y, C, M are covered with the black-ink dots b, b, b . . . which are of normal size, that is, relatively greater in size that dots y, c, m.

When flushing is carried out in the print area of the color-ink recording heads Y, C, M, ink drops are discharged by reducing the amount of ink so that the size of dots on recording paper is made as small as possible; as a result, relative positional deviation with respect to the black dots b, b, b . . . is absorbable and the recording medium can be subjected to flushing without print quality deterioration. Since flushing is carried out without the suspension of the printing operation, the ink-jet capabilities of the color-ink recording heads Y, C, M can be maintained without reduction in print speed.

When the formation of black-ink dots is not expected on a line corresponding to nozzle holes of the color-ink recording heads Y, C, M that have been determined by the flushing mode decision means 31 to require flushing (e.g., nozzle holes which are not required to discharge ink at least during the printing operation or whose discharge amount has been extremely small), the printing operation is suspended and the color-ink recording heads Y, C, M are moved to the capping position, so that flushing is carried out in the cap member 14 (S4).

Figure 5:
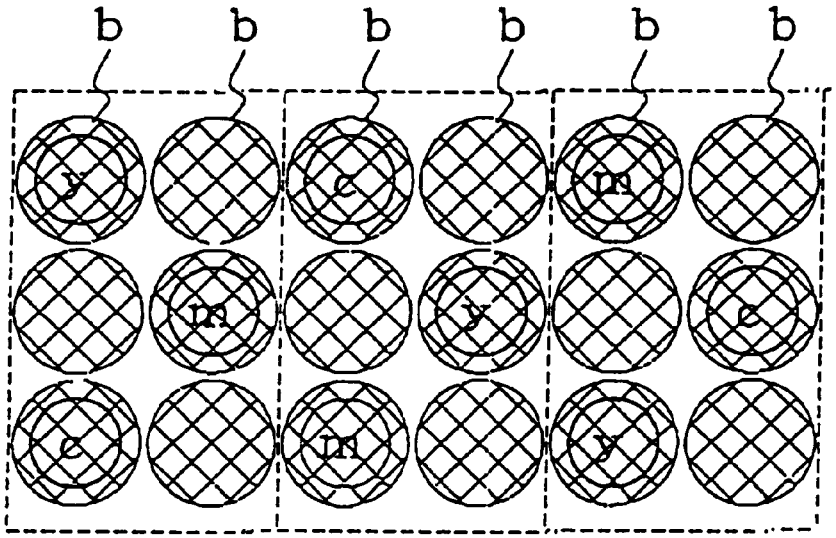
FIG. 5 is a diagram illustrating another flushing mode of the color-ink recording heads.

Although linear vertical flushing areas of the color-ink recording heads Y, C, M have been described by way of example for the sake of simplicity in the aforementioned embodiment of the invention, an area to be decentralized is divided into a plurality of blocks (three 6-dot rectangular areas enclosed with a dotted line) as shown in FIG. 5, when the black-ink dot forming area is comparatively large so that one-color ink dots y, c, m only are formed in one block; it is thus possible to make inconspicuous a reduction in the concentration of black dots b, b, b . . . based on the black-ink print data.

In other words, if dots plotted by the black dot b and the color ink dots y, c or m, are not decentralized, but concentrated on basis of the single mixed color, respectively, it seems that whole image contains mottled color, because a slight difference exists among the dots plotted by the black dots plotted by the black dot b and the color ink dots y, c, m. On the contrast, when all dots described above exist in one block, the mottled color is not recognized in view of the whole image so as to become good image.

Figure 6:
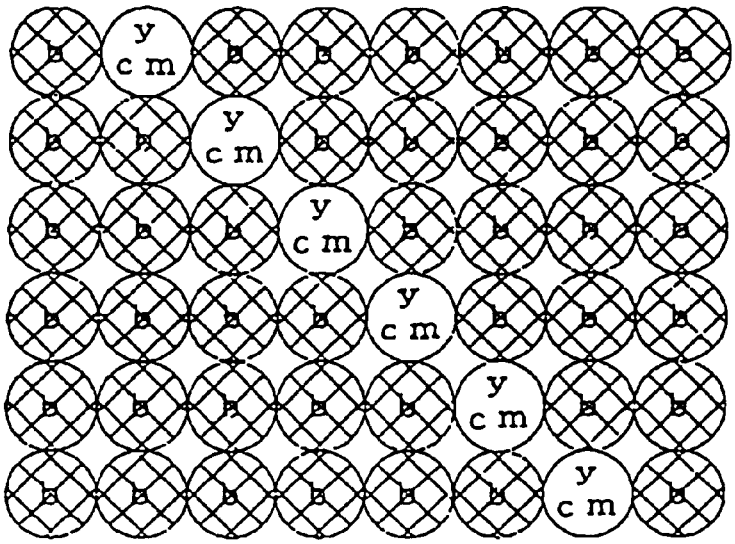
FIG. 6 is a diagram illustrating another flushing mode of the color-ink recording heads.

According to another embodiment of the present invention shown in FIG. 6, flushing for the color-ink recording heads Y, C, M is carried out in the print area. When the flushing mode decision means 31 decides that the area to be formed with black ink print data dots exists on a line corresponding the nozzle holes of the flushing-required color-ink recording heads Y, C, M, the whole nozzle hole of the flushing-required color-ink recording heads Y, C, M is caused to carry out flushing in a portion where the black-ink dots are formed, whereby three-color-ink dots y, c, m are formed in the same position.

Needless to say, so-called composite black is generated when ink of three yellow, magenta and cyan colors is superposed for printing and therefore black dots equal to those obtained from single black ink are formed. When a large amount of black-ink dots b, b, b . . . surround the composition black dots, that is, when black dots are formed by using the composite black due to flushing in only part of the area surrounded by black dots while black dots are formed in an edge area by using black ink as much as possible, the flushing of color ink can be carried out to a substantially undistinguishable extent.

If the printing operation of the black-ink recording head B is suspended by the first head driving means 24 at the locations where the three-color-ink composite black dots are formed, then black ink is saved while waste of color ink is prevented, because color ink to be consumed for flushing is effectively used for black dot printing.

Moreover, dots may be formed with black ink in the position of the composite black formed by color-ink flushing to ensure that the spots formed by the color-ink flushing are concealed.

Although a description has been given of the case where the carriage is loaded with the cartridges by way of example in the aforementioned embodiment of the invention, a similar effect is obviously achievable by applying the invention to an ink-jet color printer of such a type that ink is supplied from an ink tank installed in a casing via a tube to a recording head.

Figure 7:
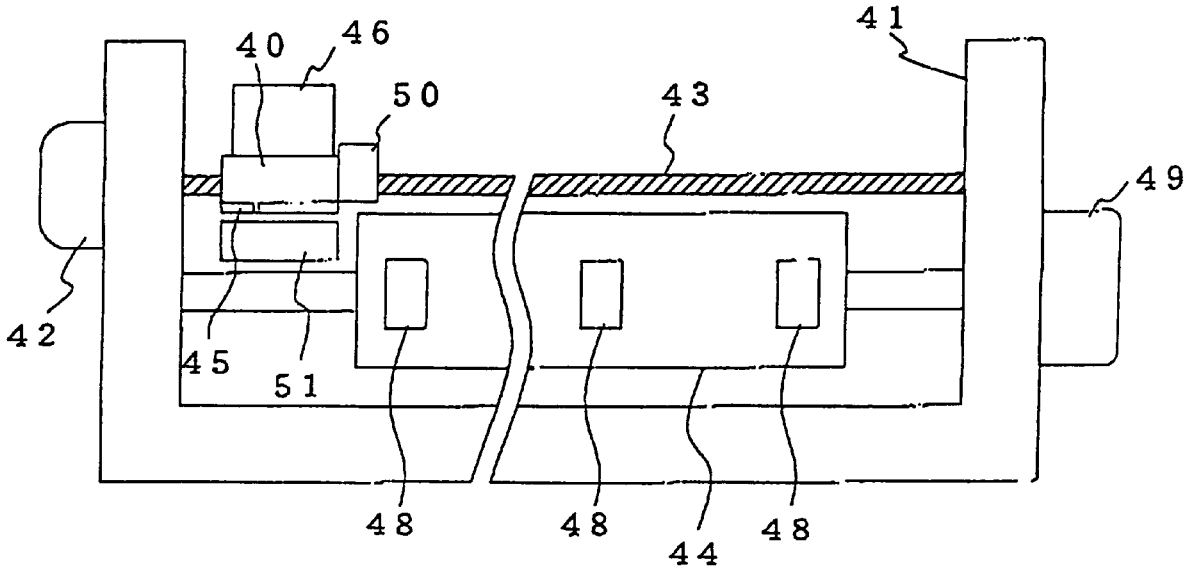
FIG. 7 is a diagram of a cutting plotter according to a second embodiment of the present invention.

FIG. 7 refers to a case where the second embodiment of the present invention is applied to a label issuing apparatus.

In FIG. 7, a carriage 40 is rotatably supported with a frame 41 and made to reciprocate in parallel to the axial direction of a platen 44 by a screw 43 which is rotated by a motor 42. A recording head 45 for discharging black ink and color ink such as yellow, cyan and magenta ink is provided opposite to the platen. An ink cartridge 46 containing black ink and color ink such as yellow, cyan and magenta ink is detachably loaded on the carriage 40. Further, a cutter 50 for cutting a recording medium to size is attached to the carriage 40, so that cuts are made in the recording medium or patterns are cut out together with pasteboards while the recording medium is moved relatively in such a manner as to surround patterns as labels according to cutting-area regulating data which is fed from a host.

The platen 44 is driven by a motor 49 to reciprocate the recording medium in cooperation with press rollers 48 in a direction perpendicular to the direction in which the carriage 40 is moved, the platen 44 being provided with a cutting table. In FIG. 7, reference numeral 51 denotes a capping unit disposed outside a print area.

Figure 8:
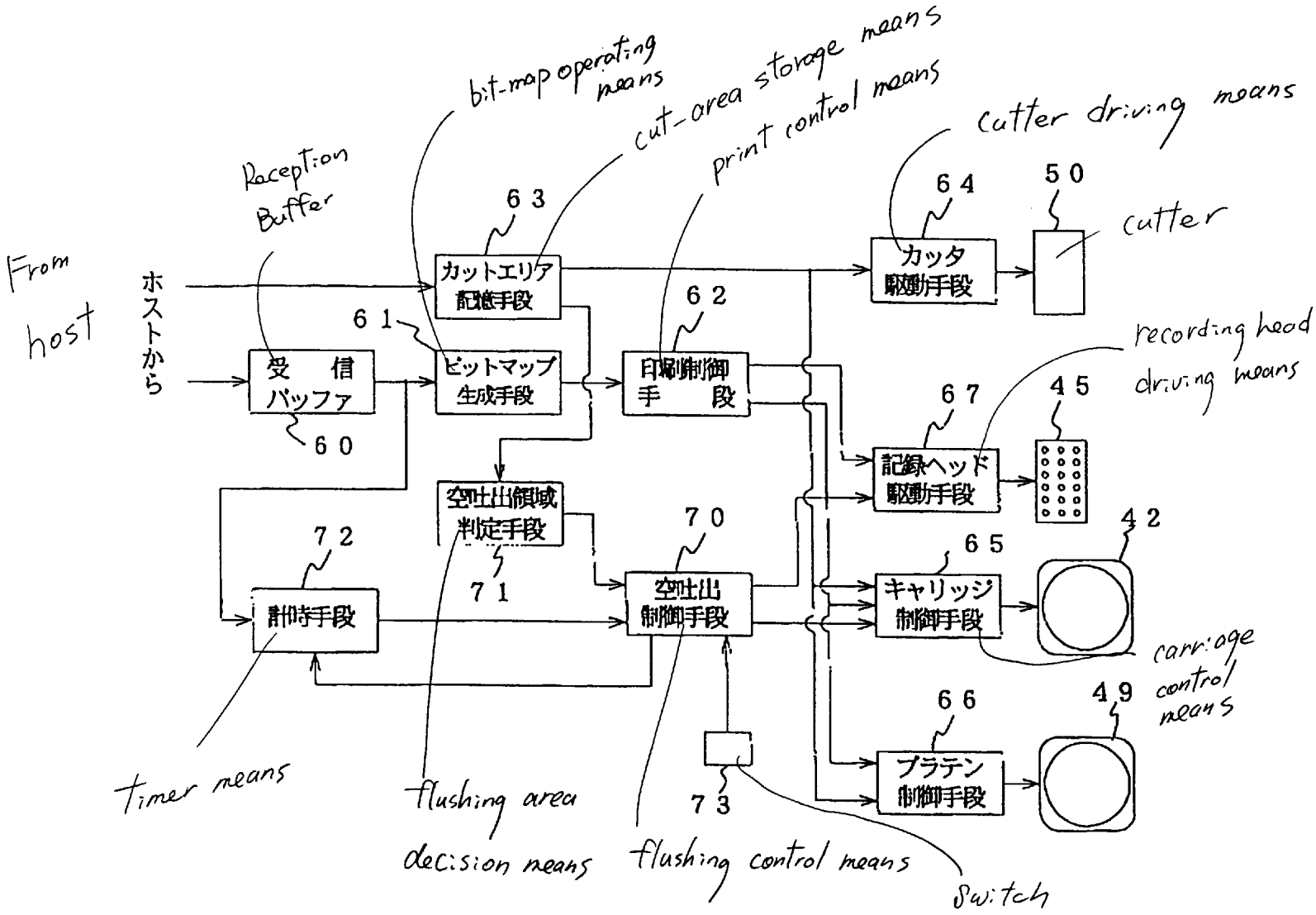
FIG. 8 is a block diagram illustrating a control unit in the apparatus shown in FIG. 7.

FIG. 8 shows a drive unit for controlling the aforementioned print mechanism according to the present invention, the drive unit functioning as a plotter comprising a reception buffer 60 for storing print data from a host (not shown), a bit-map generating means 61 for developing the print data into a bit-map image, and a print control means 62 for causing the recording head 45 to discharge ink drops while driving the carriage 40 and the platen 44.

The drive unit also has a cutting function to be performed with a cut-area storage means 63 for storing the cut-area data fed from the host, a cutter driving means 64 for attaching or detaching a cutter 50 to or from the recording medium, a carriage driving means 65, and a platen driving means 66. The cutter 50 and the recording medium are relatively moved according to the cutting data stored in a cut-area storage means 63 so as to make cuts in conformity with a cutting line C.

According to the second embodiment of the present invention, a flushing control means 70 causes the whole nozzle hole to discharge ink drops, regardless of print data from the recording head 45, according to data from a flushing area decision means 71, which will be described later, when a predetermined time indicated by a timer means 72 elapses. The flushing control means 70 also resets the timer means 72 after flushing.

The flushing area decision means 71 designates an area as a so-called marginal area, that is, an area (N) outside a label area to be cut on the basis of the cutting line C (FIG. 9) regulated according to the data stored in the cut-area storage means 63. The flushing area decision means 71 supplies the coordinates of the area (N) to the flushing control means 70. The flushing control means 70 has a switch 73 which can be operated externally to allow the printing operation to be performed as in an ordinary recording apparatus, and a control mode in which the recording head 45 is moved to the capping unit 51 and subjected to flushing under instructions from the host.

When the print data is fed from the host according to this embodiment of the invention, the timer means 72 performs the reset operation and starts the timing operation. The flushing control means 70 decides the flushing timing by reference to the timing data in the timer means 72 when the print data is developed into the bit-map data and printed on label paper. When the time at which the recording head 45 is subjected to flushing arrives after a predetermined amount of printing is carried out, the timer means 72 comes to the timeout and outputs a signal. On receiving the signal from the timer means 72, the flushing control means 70 sends a signal to the recording-head driving means 67, causing the recording head 45 to discharge ink drops onto the label paper, irrespective of the label printing, and to carry out the flushing operation when the recording head is moved to an area N. The area N becomes unnecessary when the recording head 45 is separated from each label according to the data in the flushing area decision means 71.

Figure 10:
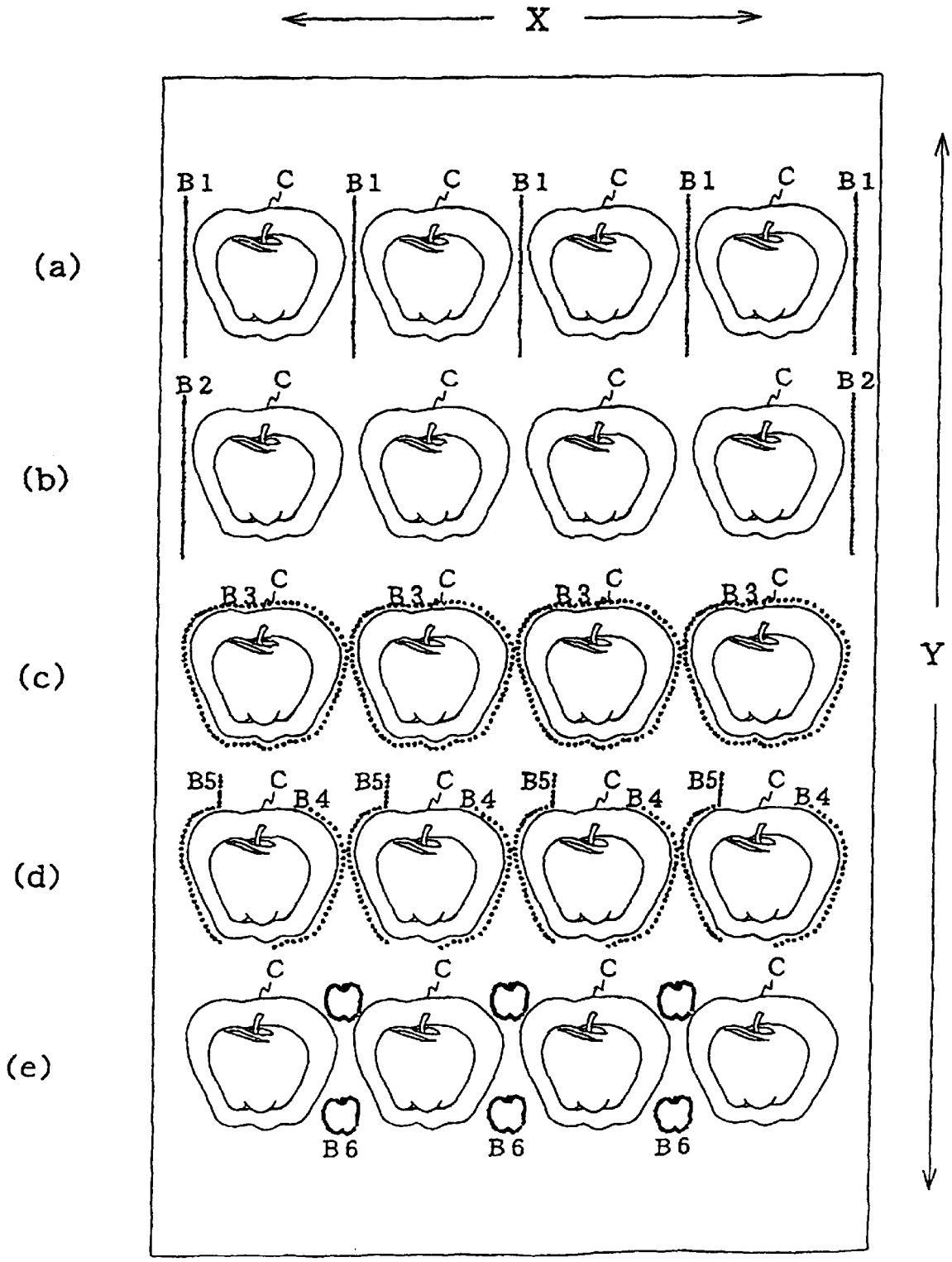
FIG. 10 is a diagram illustrating a number of flushing modes according to the second embodiment of the present invention.

Consequently, the recording head 45 carries out the flushing operation by utilizing pattern-to-pattern gaps existing in a discrete way within the same pass and forms patterns B1, B1 . . . as shown in FIG. 10(*a*). Thus the recording head 45 can dispense with the step of flushing by moving to the capping unit 51 positioned in the non-print area located far from the print area and can therefore recover the ink discharge performance of its nozzle holes without decreasing printing speed. At the time the flushing operation is terminated, the flushing control means 70 resets the timer means 72 to let the timer means 72 restart timing.

Figure 9:
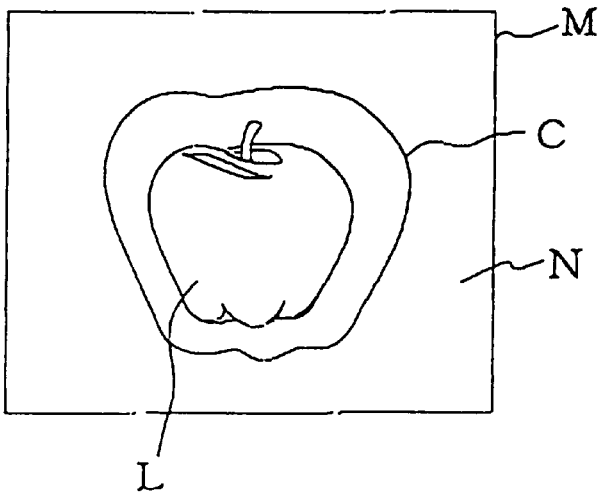
FIG. 9 is a diagram illustrating the relation between a label pattern and a cutting area.

When the pattern printing needed for labels is terminated, the platen 44 is reversely rotated to return the label paper to the initial position. Then the carriage 1 and the platen 5 are driven according to the data stored in the cut-area storage means 63 and, as shown in FIG. 9, the cutter 50 is relatively moved in conformity with the cutting line C, so that the labels are cut out in conformity with the cutting line C. Consequently, the patterns B1, B1 . . . formed during the flushing operation to prevent the nozzle holes from being clogged are separated from the respective labels. Thus, the dots formed during the flushing operation do not appear on the printed labels.

In a case where the recording head 45 is capable of color printing, the patterns B1, B1 . . . formed during the flushing operation are formed in composite black by controlling the timing at which ink of each color is discharged to the same point or as colored patterns by controlling the timing at which ink drops are discharged ink-to-ink to different positions.

In the aforementioned embodiment of the invention, a marginal area sandwiched between areas to be cut out as a label is made a flushing area. However, a flushing pattern B2 may be formed in both end areas of a recording medium as shown in FIG. 10(*b*). Although flushing is linearly carried out in the aforementioned embodiment of the invention, a pattern B3 similar to and slightly greater in extent than a cutting line may be provided close to and outside the cutting line C as shown in FIG. 10(*c*) or otherwise a linear pattern B5 in addition to a pattern B4 similar to and slightly greater in extent than a cutting line may be formed on the passage line of the nozzle hole through which no ink can be discharged with the pattern B4 as shown in FIG. 10(*d*). The flushing pattern like this can be generated easily on the basis of the result decided by the flushing mode decision means 31.

Figure 11:
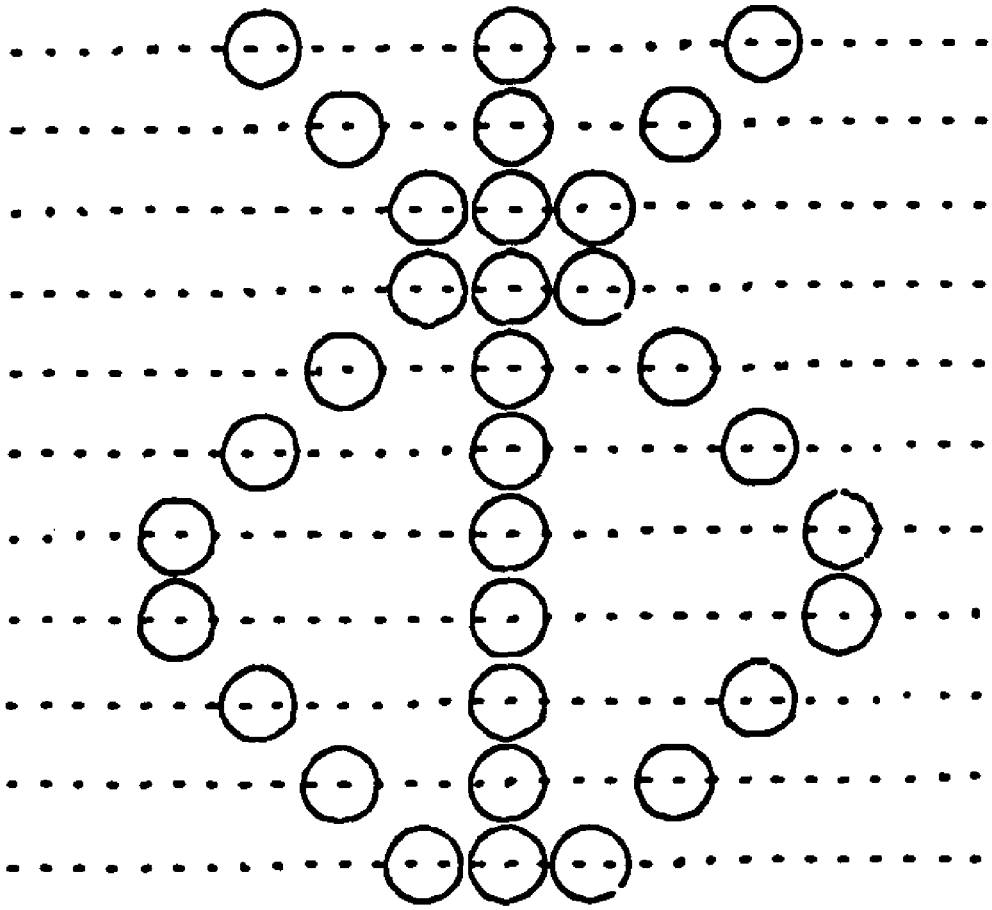
FIG. 11 is a diagram of a pattern fit of ink drops discharged by flushing.
Figure 1:
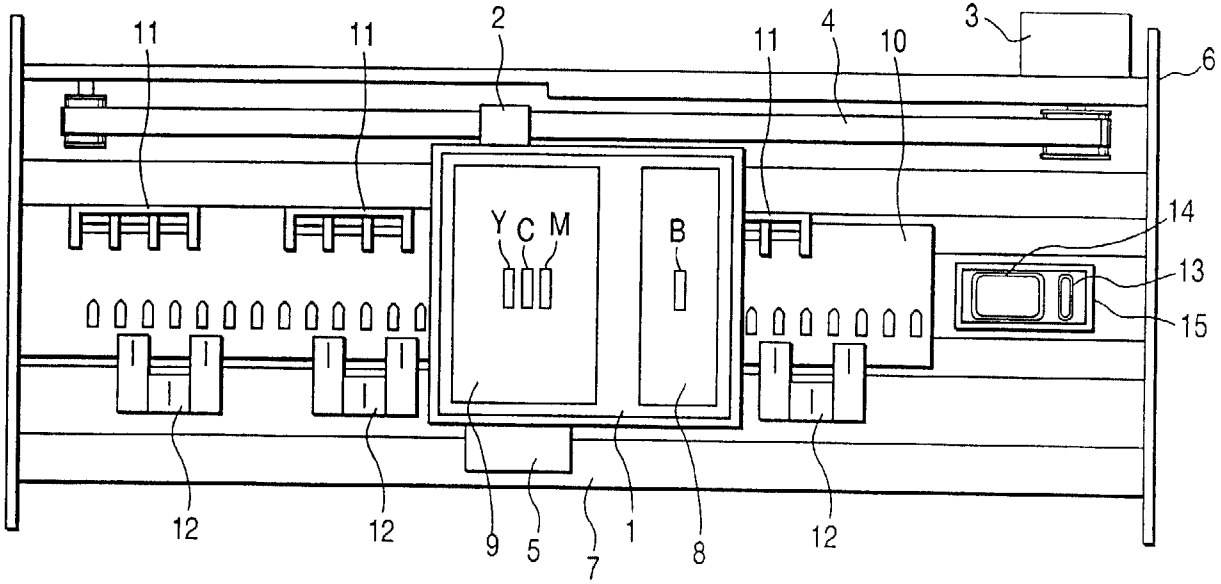

In the presence of a relatively large marginal area, a plurality of ink drops may be discharged from each nozzle of the recording head as shown in FIG. 10(*e*) so as to print a pattern. For the pattern like this, it is preferred as shown in FIG. 11 that dots are provided in positions corresponding to at least the whole nozzle hole of the recording head with a plurality of ink drops, for example, three kinds of ink drops to be discharged from the nozzle hole in each position. The provision of the flushing control means 30 and the storage means for storing such a pattern make this arrangement attainable.

Although a description has been given of a case where the label paper is cut after the printing operation is terminated in the aforementioned embodiment of the invention, the present invention is also applicable to the case of label paper having detaching cuts that have been made beforehand by feeding data on the print area or non-print area.

As the plotter type recording apparatus is fit for use in printing large-sized recording media such as posters in general, the switch 73 and the host may be used to prohibit ink drops from being discharged onto a recording medium for flushing purposes and to designate a capping unit 12 or a separate ink receiver for flushing as in an ordinary recording apparatus. In this mode of operation, Then, the flushing control means subjects the recording head 6 to flushing after moving the recording head 6 to the ink receiver such as the capping unit 15 or the like when a signal is output from timer means 32 indicating that a predetermined printing period has elapsed. The flushing control means otherwise causes ink drops to be discharged from the flushing-required nozzle holes of a color-ink recording head in a position where black-ink dots are formed so as to superpose black-ink dots by printing on the ink drops according to print data for concealing purposes, whereby the ink discharge performance of the recording head 6 can be recovered without staining the recording medium with flushing ink.

Although a description has been given of an example in which the cartridges loaded on the carriage are used to supply ink to the recording head in the aforementioned embodiment of the invention, a similar effect is obviously achievable by applying the invention to a printer of such a type that ink is supplied from an ink tank installed in a casing via a tube to a recording head.

Although a description has been given of an example of attaching a cutting mechanism to the carriage in the aforementioned embodiment of the invention, the invention is obviously applicable to such a type as to move the cutting mechanism by means of an independent mechanism.

It should be understood that the present invention is not limited to the particular embodiments disclosed herein as the best modes contemplated for carrying out the present invention, and that various modifications may be made to the disclosed embodiment without departing from the scope or spirit of the present invention. The present invention is not limited to the specific embodiments described in this specification except as defined in the appended claims.

What is claimed is:

1. An ink-jet recording apparatus comprising:

a carriage which reciprocates in a width direction of a recording medium;

a black-ink recording head, coupled to said carriage, for discharging black-ink drops;

a color-ink recording head, coupled to said carriage, for discharging color-ink drops, said color-ink recording head being periodically subjected to flushing during printing to maintain ink-drop discharge performance;

flushing mode decision means for determining, according to bit-map data used to control the black-ink recording head, the presence or absence of a location on said recording medium at which a dot is to be formed with black ink and at which a nozzle hole of said color-ink recording head will pass for discharging a color-ink drop; and flushing control means for causing, without the suspension of the printing operation when said location is present, a color-ink drop to be discharged by said nozzle hole at said location.

2. An ink-jet recording apparatus as claimed in claim 1, wherein the color-ink drop discharged at said location is smaller than the black-ink dot to be formed at said location.

3. An ink-jet recording apparatus as claimed in claim 1, wherein:

said color-ink recording head is one of a plurality of color-ink recording heads;

the flushing mode decision means determines a print area on said recording medium on which a plurality of dots is to be formed with black ink and divides the print area into a plurality of blocks; and no more than one color-ink drop is discharged by each of said plurality of color-ink recording heads within each of said blocks.

4. An ink-jet recording apparatus as claimed in claim 1, wherein the flushing mode decision means moves the color-ink recording heads to an ink receiving member in a non-print area and subjects the color-ink recording heads to flushing in the absence of said location.

5. An ink-jet recording apparatus comprising:

a carriage which reciprocates in a width direction of a recording medium;

a black-ink recording head, coupled to said carriage, for discharging black-ink drops;

color-ink recording heads, coupled to said carriage, for discharging color-ink drops, said color-ink recording heads being periodically subjected to flushing during printing to maintain ink-drop discharge performance;

flushing mode decision means for determining, according to bit-map data used to control the black-ink recording head, the presence or absence of a location on said recording medium at which a dot is to be formed with black ink and at which nozzle holes of said color-ink recording heads will pass for discharging color-ink drops; and flushing control means for causing, without the suspension of the printing operation when said location is present, three color-ink drops to be respectively discharged at said location from the nozzle holes of three of said color-ink recording heads; and head driving means for preventing ink drops from being discharged from the black-ink recording head at said location.

6. An ink-jet recording apparatus as claimed in claim 5, wherein said location is located within a black-dot printing area containing a plurality of black dots, wherein a majority of the black dots formed adjacent to said location are formed with black ink.

7. An ink-jet recording apparatus as claimed in claim 5, wherein the flushing mode decision means moves the color-ink recording heads to an ink receiving member in a non-print area and subjects the color-ink recording heads to flushing in the absence of said location.

8. An ink-jet recording apparatus, comprising:

a carriage which reciprocates in a width direction of a recording medium;

an ink-jet recording head, coupled to said carriage, for discharging ink drops;

a cutting means which reciprocates in the width direction of the recording medium, for cutting out a predetermined area according to a cutting pattern data;

a recording medium feed means, for reciprocating the recording medium in a direction perpendicular to the direction in which the carriage is moved;

decision means for determining a flushing area on said recording medium according to said cutting pattern data and for determining when flushing is necessary; and control means for subjecting the recording head to flushing when the carriage moves the recording head to the flushing area after said decision means determines that flushing is necessary.

9. An ink-jet recording apparatus as claimed in claim 8, wherein the flushing area is situated on the recording medium in proximity to an outer periphery of the recording medium.

10. An ink-jet recording apparatus as claimed in claim 8, wherein the decision means generates a flushing pattern which conforms in shape to the cutting pattern according to the cutting pattern data.

11. An ink-jet recording apparatus as claimed in claim 8, wherein the decision means generates a different flushing pattern for nozzle holes not in conformity with the cutting pattern for flushing purposes.

12. An ink-jet recording apparatus as claimed in claim 8, wherein flushing timing is controlled so that similar dots are formed by the flushing of the recording head.

13. An ink-jet recording apparatus as claimed in claim 8, wherein flushing timing is controlled so that dots different from each other are formed by the flushing of the recording head.

14. An ink-jet recording apparatus as claimed in claim 8, wherein flushing pattern data is prestored in the control means.

15. An ink-jet recording apparatus as claimed in claim 8, wherein an external signal allows the control means to switch between a label print mode and a normal print mode, and wherein, when the normal print mode is selected, the control means moves the carriage to an ink receiving member for flushing.

16. An ink-jet recording apparatus as claimed in claim 15, wherein the ink receiving member is a means for capping.

17. A method for flushing a nozzle hole of a color-ink printing head, comprising the steps of:

determining a location on a recording medium at which black dots are to be printed;

moving the nozzle hole of the color-ink printing head to said location;

discharging at said location a color-ink drop from the nozzle hole to effect flushing;

forming a black-ink dot at said location, the black-ink dot being larger than the color-ink drop.

18. A method for flushing nozzle holes of color-ink printing heads, comprising the steps of:

determining a location on a recording medium at which black dots are to be printed;

moving the nozzle holes of the color-ink printing head to said location;

discharging at said location a color-ink drop from the nozzle holes of three of said color-ink printing heads to effect flushing and to form a composite black dot at said location;

inhibiting formation of a black-ink dot at said location.

* * * * *

UNITED STATES PATENT AND TRADEMARK OFFICE

CERTIFICATE OF CORRECTION

PATENT NO. : 5,903,288
DATED : May 11, 1999
INVENTOR(S) : Yamaguchi

It is certified that error appears in the above-identified patent and that said Letters Patent is hereby corrected as shown below:

The title page should be deleted to appear as per attached title page.

Please delete drawing sheets 1-9 and substitute drawing sheets 1-9 as per attached.

Signed and Sealed this

Ninth Day of May, 2000

*Attest:*

Q. TODD DICKINSON

*Attesting Officer*

*Director of Patents and Trademarks*

US005903288A

United States Patent [19]

Yamaguchi

[11] Patent Number: 5,903,288

[45] Date of Patent: May 11, 1999

[54] APPARATUS AND METHOD FOR FLUSHING INK-JET RECORDING HEADS WITHOUT SUSPENSION OF PRINTING

[75] Inventor: Shuichi Yamaguchi, Nagano, Japan

[73] Assignee: Seiko Epson Corporation, Tokyo, Japan

[21] Appl. No.: 08/799,927

[22] Filed: Feb. 13, 1997

[30] Foreign Application Priority Data

Feb. 14, 1996 [JP] Japan ..... 8-052407
Mar. 25, 1996 [JP] Japan ..... 8-094867

[51] Int. Cl.[6] ..... B41J 2/165

[52] U.S. Cl. ..... 347/24; 347/23; 347/35

[58] Field of Search ..... 347/24, 23, 35

[56] References Cited

U.S. PATENT DOCUMENTS 4,785,750 11/1988 Best ..... 112/262.1
5,177,505 1/1993 Sugiura et al. .

FOREIGN PATENT DOCUMENTS 0500281 2/1992 European Pat. Off. .
0704307 4/1996 European Pat. Off. .

*Primary Examiner*—N. Le
*Assistant Examiner*—Thien Tran
*Attorney, Agent, or Firm*—Sughrue, Mion, Zinn Macpeak & Seas, PLLC

[57] ABSTRACT

An ink-jet recording device which carries out flushing of the nozzle holes of color-ink recording heads without suspending the printing operation. When flushing of the color-ink nozzle holes is required, the device determines, using bit-map data, whether or not black ink dots are to be printed in nearby locations that correspond to the nozzle holes requiring flushing. If so, flushing is effected by discharging color-ink drops in the locations where black-ink dots are to be formed. Subsequently, the black-ink dots that are larger than the color-ink dots are superposed over the color-ink dots, thereby concealing the color-ink dots. Alternatively, flushing of the nozzle holes of the color-ink recording heads is effected by discharging each of three colors at a location where a black-ink dot is to be formed, thereby forming a composite black dot and obviating the necessity to superpose a black-ink dot.

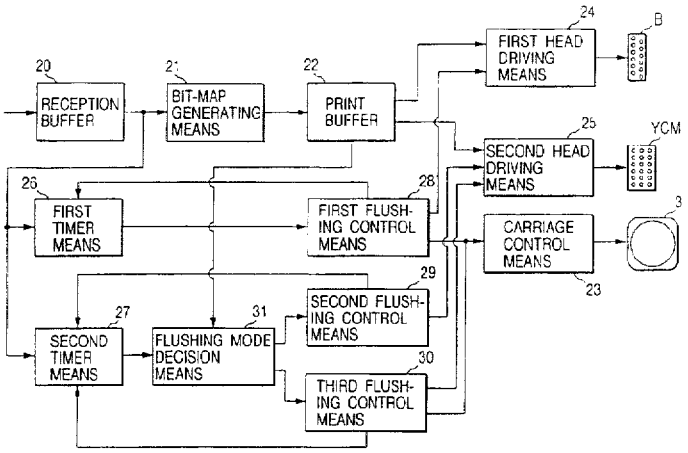

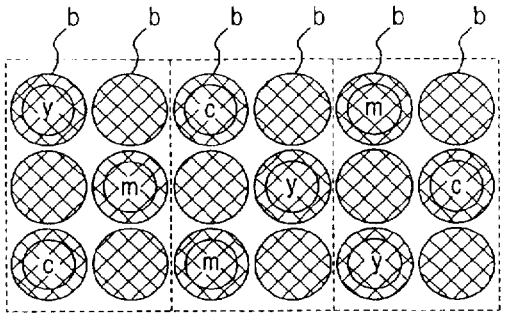

18 Claims, 9 Drawing Sheets